US009639020B1

(12) United States Patent
Kano et al.

(10) Patent No.: US 9,639,020 B1
(45) Date of Patent: May 2, 2017

(54) CLEANING DEVICE, ASSEMBLY, AND IMAGE FORMING APPARATUS

(71) Applicant: FUJI XEROX CO., LTD., Tokyo (JP)

(72) Inventors: Fuyuki Kano, Kanagawa (JP); Minoru Rokutan, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/135,981

(22) Filed: Apr. 22, 2016

(30) Foreign Application Priority Data

Oct. 29, 2015 (JP) ..... 2015-213128

(51) Int. Cl.
*G03G 15/02* (2006.01)

(52) U.S. Cl.
CPC ..... *G03G 15/0258* (2013.01)

(58) Field of Classification Search
CPC ..... G03G 15/0225
USPC ..... 399/100
See application file for complete search history.

(56) References Cited

U.S. PATENT DOCUMENTS 8,526,843 B2 * 9/2013 Terai ..... G03G 15/0225 399/100
8,526,845 B2 * 9/2013 Nonaka ..... G03G 15/0225 399/100
8,538,287 B2 * 9/2013 Kawai ..... G03G 21/0005 399/100
2012/0002998 A1 1/2012 Kawai

FOREIGN PATENT DOCUMENTS

JP 2005-301000 A 10/2005
JP 2012-14011 A 1/2012

* cited by examiner

*Primary Examiner* — William J Royer
(74) *Attorney, Agent, or Firm* — Sughrue Mion, PLLC

(57) ABSTRACT

A cleaning device includes a cleaning member, which includes a shaft portion and an elastic layer. The shaft portion is disposed so as to extend in a rotation axis direction of a rotating object that is to be cleaned. The elastic layer is helically disposed on an outer circumferential surface of the shaft portion from one end portion to the other end portion in an axial direction. The elastic layer touches an outer circumferential surface of the object and at least one end surface of the object in the rotation axis direction. A relationship between a cross-sectional area Sa of the object taken perpendicular to an axis of the object and a cumulative total contact area Sb of a portion of the end surface of the object in the rotation axis direction touched by the elastic layer during one rotation of the object satisfies $0.11 \leq Sb/Sa < 0.30$.

7 Claims, 12 Drawing Sheets

FIG. 15

| | CLEANING ROLLER | FULL LENGTH OF ELASTIC FOAM LAYER IN AXIAL DIRECTION | FULL LENGTH OF ELASTIC FOAM LAYER IN CIRCUMFERENTIAL DIRECTION | AMOUNT BY WHICH ELASTIC FOAM LAYER INTRUDES | RUBBER LENGTH OF CHARGING ROLLER IN AXIAL DIRECTION | CROSS-SECTIONAL AREA Sa TAKEN PERPENDICULARLY TO AXIS OF CHARGING ROLLER | CUMULATIVE TOTAL CONTACT AREA Sb OF END SURFACE TOUCHED BY ELASTIC FOAM LAYER | Sb/Sa | EVALUATION RESULT | |
|---|---|---|---|---|---|---|---|---|---|---|
| | | | | | | | | | HOW SMOOTHLY CHARGING MEMBER IS DRIVEN TO ROTATE | CLEANING PERFORMANCE |
| EXAMPLE 1 | CLEANING ROLLER 1 | 226 mm | 3.1 mm | 0.5 mm | 224 mm | 63.6 $mm^2$ | 7.0 $mm^2$ | 0.11 | G0.5 | G0.5 |
| EXAMPLE 2 | CLEANING ROLLER 2 | 226 mm | 3.1 mm | 0.8 mm | 224 mm | 63.6 $mm^2$ | 10.7 $mm^2$ | 0.17 | G0 | G0 |
| EXAMPLE 3 | CLEANING ROLLER 3 | 226 mm | 3.1 mm | 1.4 mm | 224 mm | 63.6 $mm^2$ | 18.0 $mm^2$ | 0.28 | G0.5 | G0.5 |
| EXAMPLE 4 | CLEANING ROLLER 4 | 226 mm | 4.1 mm | 0.5 mm | 224 mm | 63.6 $mm^2$ | 9.4 $mm^2$ | 0.15 | G0 | G0 |
| EXAMPLE 5 | CLEANING ROLLER 5 | 226 mm | 5.2 mm | 0.5 mm | 224 mm | 63.6 $mm^2$ | 10.6 $mm^2$ | 0.17 | G0 | G0 |
| EXAMPLE 6 | CLEANING ROLLER 6 | 226 mm | 5.2 mm | 0.8 mm | 224 mm | 63.6 $mm^2$ | 16.1 $mm^2$ | 0.25 | G0 | G0 |
| EXAMPLE 7 | CLEANING ROLLER 7 | 226 mm | 6.2 mm | 0.5 mm | 224 mm | 63.6 $mm^2$ | 12.8 $mm^2$ | 0.2 | G0 | G0 |
| EXAMPLE 8 | CLEANING ROLLER 8 | 226 mm | 3.1 mm (END PORTION 5.2 mm) | 0.5 mm | 224 mm | 63.6 $mm^2$ | 10.6 $mm^2$ | 0.17 | G0 | G0 |
| EXAMPLE 9 | CLEANING ROLLER 9 | 226 mm | 3.1 mm (END PORTION 5.2 mm) | 0.8 mm | 224 mm | 63.6 $mm^2$ | 16.1 $mm^2$ | 0.25 | G0 | G0 |
| COMPARATIVE EXAMPLE 1 | COMPARATIVE CLEANING ROLLER 1 | 226 mm | 3.1 mm | 0.2 mm | 224 mm | 63.6 $mm^2$ | 3.4 $mm^2$ | 0.05 | G1 | G2 |
| COMPARATIVE EXAMPLE 2 | COMPARATIVE CLEANING ROLLER 2 | 226 mm | 3.1 mm | 1.5 mm | 224 mm | 63.6 $mm^2$ | 19.2 $mm^2$ | 0.30 | G2 | G2 |
| COMPARATIVE EXAMPLE 3 | COMPARATIVE CLEANING ROLLER 3 | 226 mm | 5.2 mm | 0.2 mm | 224 mm | 63.6 $mm^2$ | 5.6 $mm^2$ | 0.09 | G1 | G2 |
| COMPARATIVE EXAMPLE 4 | COMPARATIVE CLEANING ROLLER 4 | 224 mm | 3.1 mm | 0.5 mm | 224 mm | 63.6 $mm^2$ | 0 $mm^2$ | 0 | G2 | G2 |
| COMPARATIVE EXAMPLE 5 | COMPARATIVE CLEANING ROLLER 5 | 224 mm | 3.1 mm | 0.8 mm | 224 mm | 63.6 $mm^2$ | 0 $mm^2$ | 0 | G2 | G1 |

CLEANING DEVICE, ASSEMBLY, AND IMAGE FORMING APPARATUS

CROSS-REFERENCE TO RELATED APPLICATIONS

This application is based on and claims priority under 35 USC 119 from Japanese Patent Application No. 2015-213128 filed Oct. 29, 2015.

BACKGROUND

Technical Field

The present invention relates to cleaning devices, assemblies, and image forming apparatuses.

SUMMARY

According to an aspect of the invention, a cleaning device includes a cleaning member. The cleaning member includes a shaft portion, disposed so as to extend in a rotation axis direction of a rotating object that is to be cleaned, and an elastic layer, helically disposed on an outer circumferential surface of the shaft portion from one end portion to the other end portion in an axial direction. The elastic layer touches an outer circumferential surface of the object and at least one end surface of the object in the rotation axis direction. In the device, a relationship between a cross-sectional area Sa of the object taken perpendicular to an axis of the object and a cumulative total contact area Sb of a portion of the at least one end surface of the object in the rotation axis direction touched by the elastic layer during one rotation of the object satisfies approximately $0.11 \leq Sb/Sa <$ approximately 0.30.

BRIEF DESCRIPTION OF THE DRAWINGS

Exemplary embodiments of the present invention will be described in detail based on the following figures, wherein:

FIG. 15 is a table showing evaluation results of embodiments and comparative examples.

DETAILED DESCRIPTION

Figure 1:
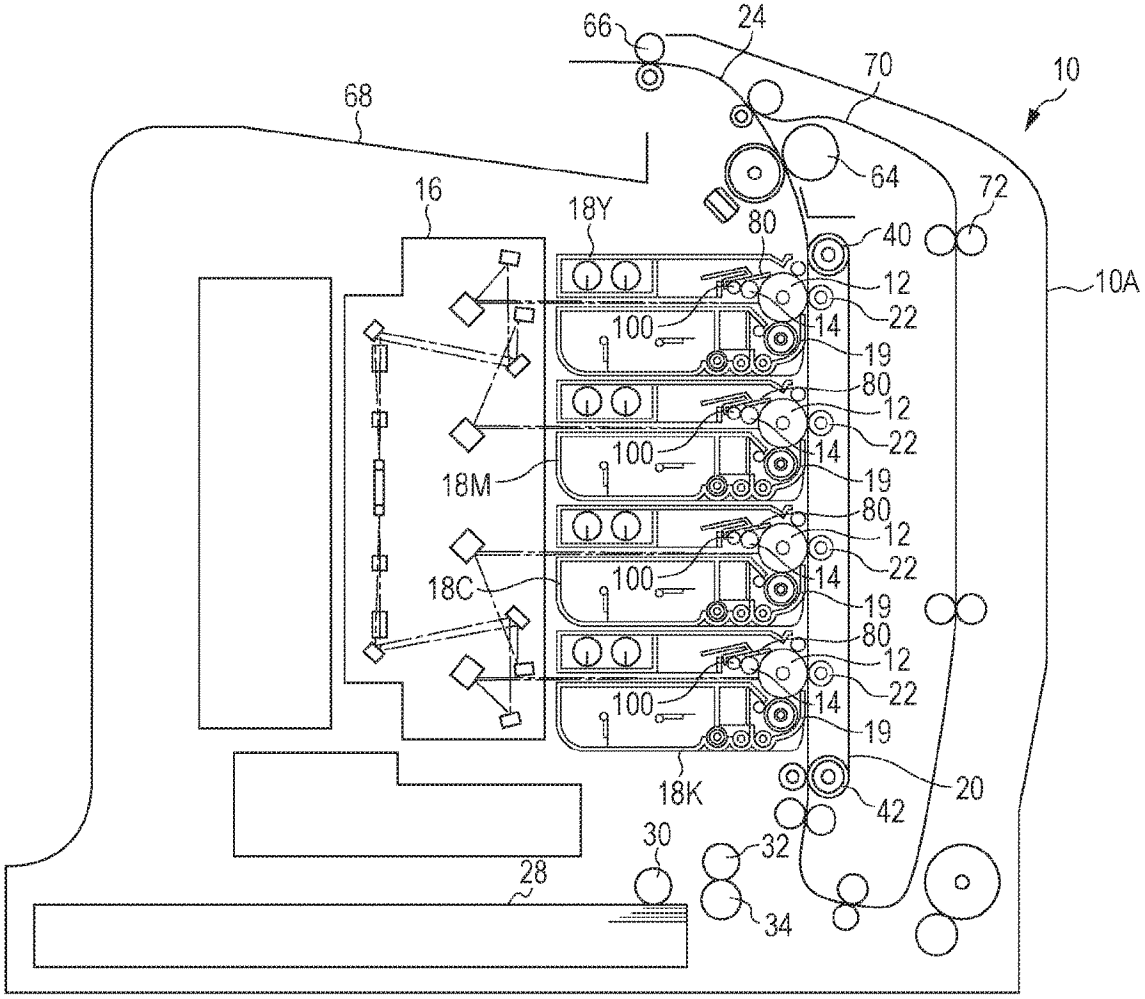
FIG. 1 is a schematic configuration diagram of an electrophotographic image forming apparatus according to an exemplary embodiment.

Referring now to the drawings, exemplary embodiments according to the invention are described below. Components having the same functions and operations are denoted with the same reference symbols throughout the drawings and may not be described.

Image Forming Apparatus 10

An image forming apparatus 10 according to an exemplary embodiment is described. FIG. 1 is a schematic configuration diagram of an image forming apparatus 10 according to an exemplary embodiment.

As illustrated in FIG. 1, the image forming apparatus 10 according to this exemplary embodiment is, for example, a tandem color image forming apparatus. The image forming apparatus 10 includes an apparatus body 10A. The apparatus body 10A contains process cartridges 18Y, 18M, 18C, and 18K (hereinafter collectively denoted by 18), respectively corresponding to yellow (Y), magenta (M), cyan (C), and black (K).

Figure 2:
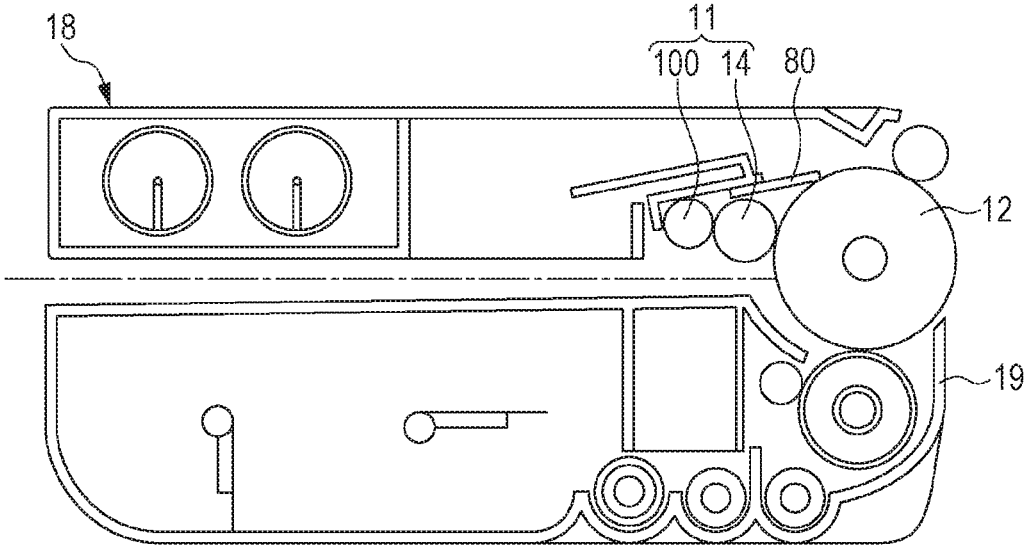
FIG. 2 is a schematic configuration diagram of a process cartridge according to an exemplary embodiment.

As illustrated in FIG. 2, each process cartridge 18 includes a photoconductor 12 (an example of an image carrier or an example of an object that is to be charged), which is capable of holding images, a charging device 11 (an example of a cleaning device), which includes a charging member 14 (an example of an object that is to be cleaned and an example of a charger), and a developing device 19. The process cartridges 18 are attachable to and detachable from the apparatus body 10A. Each process cartridge 18 serves as an example of an assembly attachable to and detachable from the apparatus body 10A as an integral unit. Here, the assembly according to this exemplary embodiment suffices as long as it includes at least the photoconductor 12 and the charging device 11.

The surface of each photoconductor 12 is charged with electricity by the corresponding charging member 14 disposed on the surface of the photoconductor 12, and then subjected to image exposure using a laser beam emitted from an exposure device 16 at a position downstream of the charging member 14 in the direction of rotation of the photoconductor 12. Thus, an electrostatic latent image corresponding to image data is formed on the surface of the photoconductor 12.

An electrostatic latent image formed on each photoconductor 12 is developed by the corresponding developing device 19 of yellow (Y), magenta (M), cyan (C), or black (K) and formed into a toner image of the corresponding color.

When, for example, a color image is to be formed, the surface of each photoconductor 12 corresponding to yellow (Y), magenta (M), cyan (C), or black (K) is charged with electricity, exposed to light, and subjected to development.

Thus, a toner image corresponding to yellow (Y), magenta (M), cyan (C), or black (K) is formed on the surface of the photoconductor 12 of the corresponding color.

Toner images of yellow (Y), magenta (M), cyan (C), and black (K) sequentially formed on the respective photoconductors 12 are transferred to a recording medium 24, transported along a transport belt 20 and located in the outer circumference of the photoconductors 12, at a portion at which the photoconductors 12 and a transfer device 22 come into contact with each other with the transport belt 20 interposed therebetween, the transport belt 20 being supported at the inner circumferential surface by support rollers 40 and 42 while receiving tension from the support rollers 40 and 42. The recording medium 24 to which the toner images have been transferred from the surfaces of the photoconductors 12 is transported to a fixing device 64, the toner image is heated and pressed by the fixing device 64, and the toner images are fixed to the recording medium 24. In the case of single-sided printing, the recording medium 24 to which the toner images have been fixed is then ejected by ejection rollers 66 onto an ejection portion 68 disposed on an upper portion of the image forming apparatus 10.

The recording medium 24 is picked up by a pick-up roller 30 from a storage container 28 and transported to the transport belt 20 by transport rollers 32 and 34.

In the case of double-sided printing, on the other hand, the ejection rollers 66 are reversed while holding a trailing end portion of a recording medium 24, having a first side (upper surface) to which the toner images have been fixed by the fixing device 64, without ejecting the recording medium 24 to the ejection portion 68. Thus, the recording medium 24 is introduced into a transport path 70 for double-sided printing. Transport rollers 72 disposed on the transport path 70 for double-sided printing allow the recording medium 24 to be transported onto the transport belt 20 again while the recording medium 24 is being turned upside down. Then, toner images are transferred to the second side (undersurface) of the recording medium 24 from the surfaces of the photoconductors 12. Thereafter, the toner images on the second side (undersurface) of the recording medium 24 are fixed by the fixing device 64 and the recording medium 24 (object to which an image is transferred) is ejected onto the ejection portion 68.

Foreign matter such as toner or paper dust remaining on the surface of the photoconductor 12 after the completion of a toner image transfer step is removed every rotation of the photoconductor 12 by a cleaning blade 80 disposed at a portion on the surface of the photoconductor 12 downstream of a portion of the photoconductor 12 with which the transfer device 22 comes into contact in the rotation direction of the photoconductor 12. Thus, the photoconductor 12 is prepared for a subsequent image forming process.

The image forming apparatus 10 according to this exemplary embodiment is not limited to the above-described configuration. The image forming apparatus 10 according to this exemplary embodiment may be another type of widely-known image forming apparatuses such as an intermediate transfer image forming apparatus.

Charging Device 11

Figure 3:
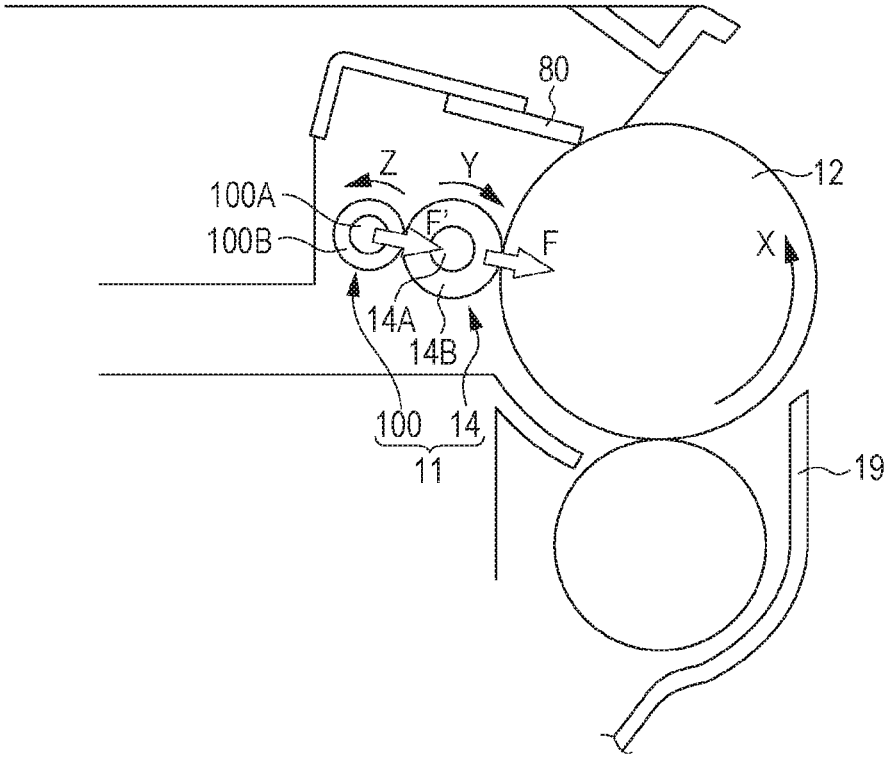
FIG. 3 is a schematic configuration diagram of a portion around one charging member (charging device) illustrated in FIG. 1 and FIG. 2, viewed in an enlarged manner.

As illustrated in FIG. 3, the charging device 11 includes the above-described charging member 14, which charges the photoconductor 12 with electricity, and a cleaning member 100, which cleans the charging member 14.

Charging Member 14

The charging member 14 is, for example, a roller formed by disposing an elastic layer 14B around an electric conductive core body 14A. The core body 14A is rotatably supported by bearings (not illustrated). The charging member 14 forms a nip portion as a result of being pressed against the photoconductor 12 upon receipt of a load F at both ends of the core body 14A and then being elastically deformed along the circumferential surface of the elastic layer 14B.

As described below, when the cleaning member 100 is pressed against the charging member 14 upon receipt of a load F' at both ends, a nip portion is formed between the charging member 14 and the photoconductor 12 while the charging member 14 is prevented from bending.

When the photoconductor 12 is driven to rotate in the direction of arrow X by a motor not illustrated, the charging member 14 is driven to rotate in the direction of arrow Y by the rotation of the photoconductor 12. The cleaning member 100 is driven to rotate in the direction of arrow Z by the rotation of the charging member 14.

Material of Charging Member 14

The configuration of the charging member 14 is not limited to a particular configuration. Examples of the configuration of the charging member 14 include a configuration including the core body 14A and the elastic layer 14B and a configuration including the core body 14A and a resin layer instead of the elastic layer 14B. The elastic layer 14B may be a single layer or composed of multiple different layers having different functions. The elastic layer 14B may be subjected to surface treatment.

Preferably, a material such as free-cutting steel or stainless steel is used as the material of the core body 14A. Preferably, the material or the surface treatment is appropriately selected depending on the properties such as a sliding capability. Preferably, the core body 14A is subjected to plating. In the case of a material having no electric conductivity, the material may be rendered electrically conductive by being subjected to a typical process such as plating or may be used as it is.

Here, the elastic layer 14B is an electric conductive elastic layer. The electric conductive elastic layer may contain, for example, an elastic material such as rubber having elasticity and materials normally added to rubber, for example, an electric conductive agent such as carbon black or an ionic conductive agent for adjusting the resistance of the electric conductive elastic layer, or, when needed, a softener, a plasticizer, a hardener, a curing agent, a vulcanization accelerator, an age resistor, or a filler such as silica or calcium carbonate. The elastic layer 14B is formed by coating the circumferential surface of the electric conductive core body 14A with the mixture of rubber and materials normally added to rubber. Examples of the electric conductive agent for adjusting the resistance value include a material in which a material that conducts electricity using either one or both of electrons and ions as charge carriers is dispersed, as in the case of carbon black or an ionic conductive agent mixed in a matrix material. The elastic material may be in a foam body.

The elastic material constituting the electric conductive elastic layer is formed by, for example, dispersing an electric conductive agent in the rubber material. Preferably usable examples of the rubber material include silicone rubber, ethylene-propylene rubber, epichlorohydrin-ethylene oxide copolymer rubber, epichlorohydrin-ethylene oxide-allyl glycidyl ether copolymer rubber, acrylonitrile-butadiene copolymer rubber, and rubber in which any of these types of rubber is blended. These rubber materials may be in a foam or non-foam body.

An electronic or ionic conductive agent is used as an example of the electric conductive agent. Examples of the electronic conductive agent include impalpable powder of carbon black such as Ketjenblack or acetylene black; pyrocarbon or graphite; various types of electric conductive metal or alloy such as aluminum, copper, nickel, or stainless steel; various types of electric conductive metallic oxide such as tin oxide, indium oxide, titanium oxide, tin oxide-antimony oxide solid solution, or tin oxide-indium oxide solid solution; and an insulating material whose surface is rendered electrically conductive. Examples of the ionic conductive agent include onium perchlorates or chlorates such as tetraethylammonium or lauryltrimethylammonium and alkali-metal or alkaline-earth-metal perchlorates or chlorates such as lithium or magnesium.

Any one of the above-described electric conductive agents may be used alone or two or more of the above-described electric conductive agents may be used in combination. The contents of the electric conductive agents are not limited to particular values. In the case of the electronic conductive agent, preferably, the content falls within the range of 1 part by weight to 60 parts by weight with respect to 100 parts by weight of rubber material. In the case of the ionic conductive agent, on the other hand, preferably, the content falls within the range of 0.1 parts by weight to 5.0 parts by weight with respect to 100 parts by weight of rubber material.

A surface layer may be formed on the surface of the charging member 14. The material of the surface layer is not limited to a particular material and any material including resin and rubber may be used as a material of the surface layer. Preferably usable examples include polyvinylidene fluoride, tetrafluoroethylene copolymer, polyester, polyimide, and copolymer nylon. In addition, fluorine-based or silicone-based resin is preferably usable as the surface layer. Particularly, fluorine-modified acrylate polymer is used as the surface layer.

Cleaning Member 100

Figure 4:
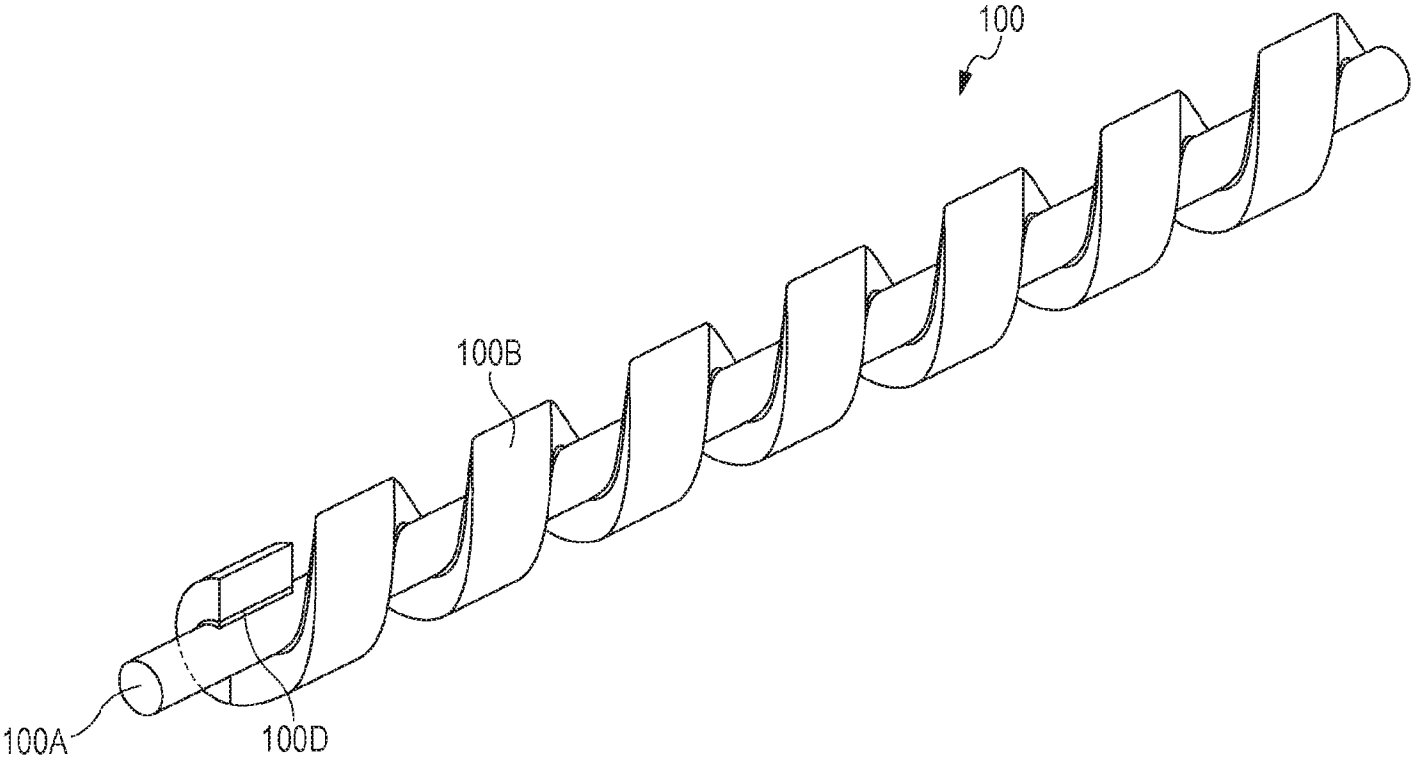
FIG. 4 is a schematic perspective view of a cleaning member according to an exemplary embodiment.
Figure 5:
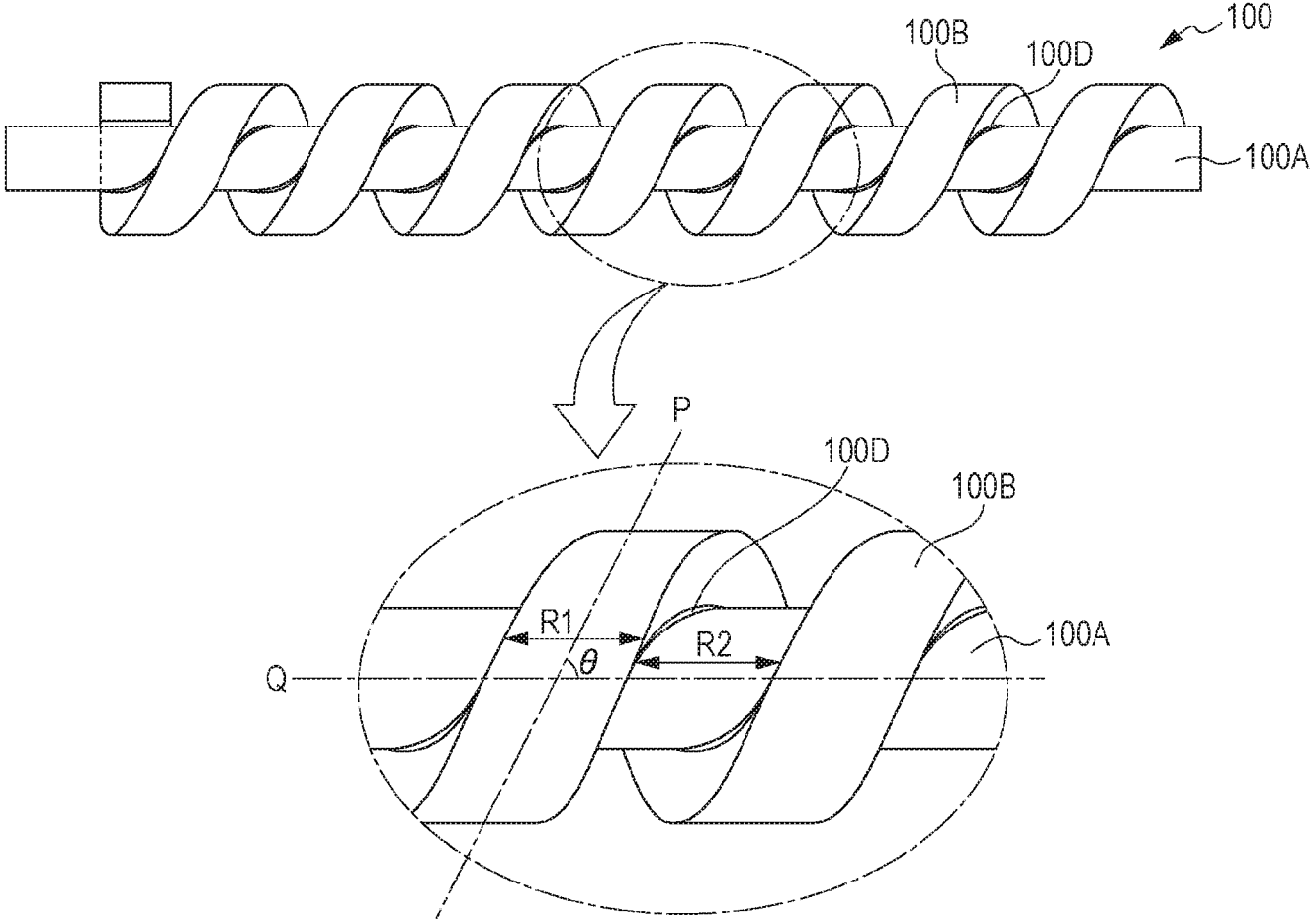
FIG. 5 is a schematic plan view of the cleaning member according to the exemplary embodiment.

FIG. 4 is a schematic perspective view of the cleaning member 100 according to this exemplary embodiment. FIG. 5 is a schematic plan view of the cleaning member 100 according to this exemplary embodiment.

As illustrated in FIGS. 4 and 5, the cleaning member 100 according to this exemplary embodiment is a roller-shaped member. The cleaning member 100 includes a core body 100A (example of shaft portion), an elastic foam layer 100B (example of elastic layer), and a bonding layer 100D for bonding the core body 100A and the elastic foam layer 100B together.

As illustrated in FIG. 3, in the cleaning member 100, the elastic foam layer 100B is in contact with the charging member 14 on the side of the charging member 14 opposite to the side on which the photoconductor 12 is in contact. Specifically, the cleaning member 100 is pressed against the charging member 14 while receiving the load F' at both ends of the core body 100A so that the elastic foam layer 100B is elastically deformed along the circumferential surface of the charging member 14 so as to form a nip portion. Thus, the outer circumferential surface of the elastic foam layer 100B is in contact with the outer circumferential surface of the elastic layer 14B of the charging member 14 while intruding into the elastic layer 14B by a predetermined amount.

The cleaning member 100 is driven to rotate in the direction of arrow Z by rotation of the charging member 14. Here, the configuration is not limited to the one in which the cleaning member 100 is constantly in contact with the charging member 14. The cleaning member 100 may be brought into contact with and driven to rotate by the charging member 14 only at the time of cleaning the charging member 14. Alternatively, the cleaning member 100 may be brought into contact with the charging member 14 only at the time of cleaning the charging member 14 and separately driven to rotate at a peripheral speed different from that at which the charging member 14 rotates.

Core Body 100A

Examples of the material of the core body 100A include metal (such as free-cutting steel and stainless steel) and resin (such as polyacetal resin (POM)). The material of the core body 100A, the method of surface treatment, or other factors may be appropriately selected as needed.

Particularly, when the core body 100A is made of metal, it is preferable that the core body 100A be subjected to plating. In the case of a material having no electric conductivity such as resin, the material may be rendered electrically conductive by being subjected to a typical process such as plating or may be used as it is.

Figure 8:
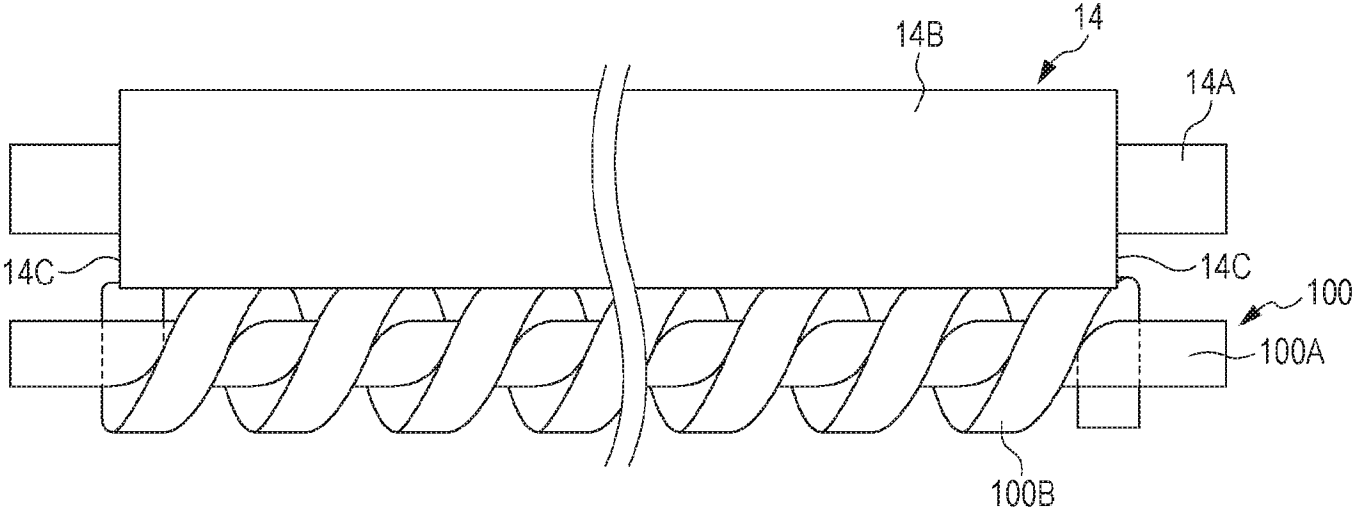
FIG. 8 is a schematic plan view of the cleaning member and the charging member according to the exemplary embodiment.

As illustrated in FIG. 8, the core body 100A is disposed so as to extend in the direction of the rotational axis of the charging member 14 (or also simply referred to as "axial direction" below). The length of the core body 100A in the axial direction is longer than the length of the elastic layer 14B of the charging member 14 in the axial direction. End portions of the core body 100A in the axial direction protrude outward beyond respective end portions of the elastic layer 14B of the charging member 14 in the axial direction.

Bonding Layer 100D

The bonding layer 100D may be composed of any material that is capable of bonding the core body 100A and the elastic foam layer 100B together. For example, the bonding layer 100D is composed of double-sided tape or other adhesives.

Elastic Foam Layer 100B

The elastic foam layer 100B is composed of a material containing air bubbles (so called foam). Specific materials of the elastic foam layer 100B are described below. The elastic layer may be a non-foam elastic layer (containing no air bubbles), instead.

As illustrated in FIGS. 4 and 5, the elastic foam layer 100B is helically disposed on the outer circumferential surface of the core body 100A from one end to the other end of the core body 100A in the axial direction. Specifically, as illustrated in FIGS. 10 to 12D, the elastic foam layer 100B is helically wound around the core body 100A from, for example, one end to the other end of the core body 100A in the axial direction using the core body 100A as an axis in such a manner that a strip-shaped elastic foam member 100C (hereinafter also referred to as a strip 100C) is wound at intervals.

Figure 6:
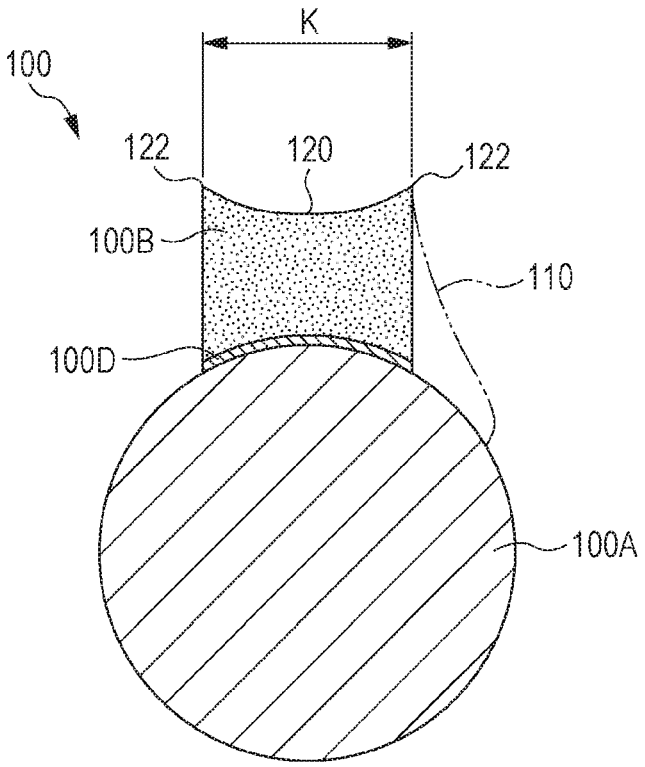
FIG. 6 is a schematic cross-sectional view of the cleaning member according to the exemplary embodiment when viewed in an axial direction.

As illustrated in FIG. 6, in a cross section viewed in the axial direction of the core body 100A, the elastic foam layer 100B has a quadrilateral shape, defined by four sides (including curves). The elastic foam layer 100B has protrusions 122 at both end portions in the widthwise direction (K direction) of the elastic foam layer 100B, the protrusions 122 protruding outward in the radial direction of the core body 100A beyond a middle portion 120. These protrusions 122 extend in the lengthwise direction of the elastic foam layer 100B.

In each protrusion 122, the outer diameter differs between the widthwise middle portion 120 and the widthwise end portions of the outer circumferential surface of the elastic foam layer 100B, the difference arising from, for example, an application of tension to the elastic foam layer 100B in the longitudinal direction of the elastic foam layer 100B.

An end portion of the strip 100C in the axial direction may be subjected to a compression treatment in the direction of the thickness so as to be prevented from coming off after being bonded to the core body 100A. Specifically, a compression treatment (thermocompression treatment) is performed on an end portion of the strip 100C in the axial direction before being bonded to the core body 100A, by applying heat or pressure in such a manner that, for example, the compression rate (thickness after compression/thickness before compression×100) in the thickness direction falls within the range of 10% to 70%. When the strip 100C is subjected to a compression treatment, a portion subjected to compression is plastically deformed into a compressed state (squashed state). In the portion subjected to the compression treatment, the air bubbles are left in the squashed state.

As illustrated in FIG. 8, in the state where the elastic foam layer 100B is helically wound around the core body 100A, the length of the elastic foam layer 100B in the axial direction along the axis of the core body 100A (cleaning member 100) is longer than the length of the elastic layer 14B of the charging member 14 in the axial direction. In this state, end portions of the elastic foam layer 100B in the axial direction protrude outward beyond the respective end portions of the elastic layer 14B in the axial direction. Thus, the portions of the elastic foam layer 100B protrude toward the core body 14A (upward in FIG. 8) of the charging member 14 and touch both edges (corners) of at the ends of the elastic layer 14B in the axial direction and end surfaces 14C in the axial direction. Here, the amount by which the elastic foam layer 100B protrudes toward the core body 14A corresponds to the above-described amount by which the elastic foam layer 100B intrudes into the charging member 14.

In this exemplary embodiment, the relationship between a cross-sectional area Sa of the charging member 14, taken perpendicularly to the axis of the charging member 14, and a cumulative total contact area Sb of a portion of the end surface 14C in the rotation axis direction touched by the elastic foam layer 100B during one rotation of the charging member 14 satisfies approximately $0.11 \leq Sb/Sa <$ approximately 0.30. It is more preferable that the relationship between the cross-sectional area Sa of the charging member 14 and the cumulative total contact area Sb satisfy approximately $0.15 \leq Sb/Sa \leq$ approximately 0.25.

Figure 7:
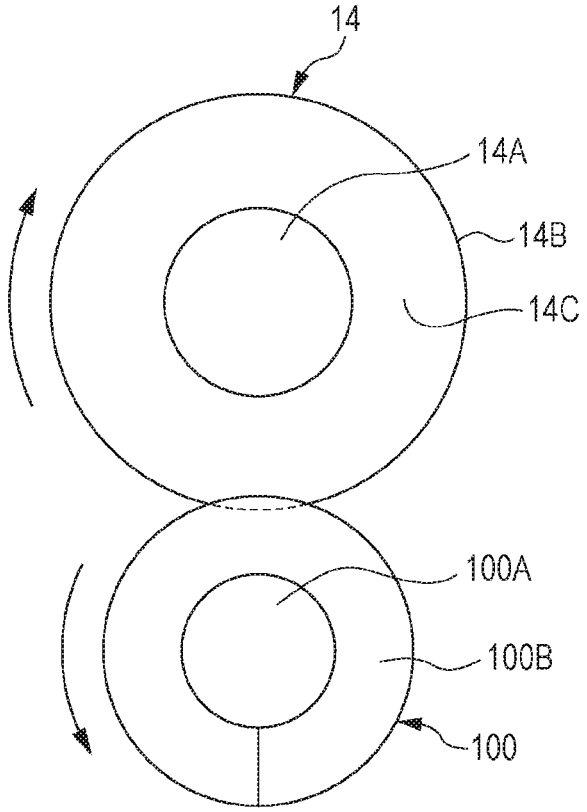
FIG. 7 is a schematic side view of the cleaning member and the charging member according to the exemplary embodiment when viewed in the axial direction.

As illustrated in FIG. 7, the "cross-sectional area Sa of the charging member 14, taken perpendicularly to the axis of the charging member 14" indicates the entire cross-sectional area of the charging member 14 including the core body 14A and the elastic layer 14B when the charging member 14 is viewed in the axial direction.

As illustrated in FIG. 7, the "cumulative total contact area Sb" indicates the cumulative total area of portions of the end surfaces 14C in the axial direction touched by the elastic foam layer 100B during one rotation of the charging member 14 when the charging member 14 is viewed in the axial direction.

The "cumulative total contact area Sb" is measured and calculated by the following method. When the charging member 14 is viewed in the axial direction (see FIG. 7), the area of the end surface 14C in the rotation axis direction touched by the portions of the elastic foam layer 100B intruded into the elastic layer 14B is measured. Specifically, the cleaning member 100 in which a coloring agent (such as a Y color toner for a color laser printer DocuPrint CP400d from Fuji Xerox Co., Ltd.) is attached to portions of the elastic foam layer 100B that touch the end surfaces is brought into contact with the charging member 14 so as to intrude into the charging member 14 by an intended amount (for example, the cleaning member 100 is installed on a drum cartridge of a monochrome laser printer DocuPrint P355d from Fuji Xerox Co., Ltd. described in the exemplary embodiment). Then, the cleaning member 100 is driven to rotate at 100 rpm by at least the width over which the elastic foam layer 100B is laid in the circumferential direction to color the end surfaces 14C in the axial direction. The colored portions of the end surfaces 14C in the axial direction are imaged by an image analysis device (for example, a digital microscope VHX-900 from Keyence Corporation) and subjected to an image analysis so that the area of the colored portions is measured. The measured area is defined as a contact area. The cumulative total contact area Sb is acquired in the following manner. The difference between the outer diameter of the charging member 14 and the outer diameter of the cleaning member 100 is estimated. (1) In the case where the elastic foam layer 100B makes contact once during one rotation of the charging member 14, the value of the contact area is used as it is. (2) In the case where the elastic foam layer 100B makes contact twice during one rotation of the charging member 14, the contact area corresponding to the contact range of the second contact of the elastic foam layer 100B is calculated and added to the area of the first contact to obtain the cumulative total contact area Sb. Here, calculation is performed assuming that the rate of rotation of the cleaning member 100 with respect to rotation of the charging member 14 is 100%. In other words, calculation is performed assuming that the cleaning member 100 is driven to rotate without slipping over on the charging member 14.

Material and Other Properties of Elastic Foam Layer 100B

Examples of the material of the elastic foam layer 100B include a material obtained by blending one or more materials selected from resin foam such as polyurethane, polyethylene, polyamide, or polypropylene and rubber such as silicone rubber, fluorocarbon rubber, polyurethane rubber, EPDM, NBR, CR, chlorinated polyisoprene, isoprene, acrylonitrile-butadiene rubber, styrene-butadiene rubber, hydrogenated polybutadiene, or butyl rubber.

As needed, other agents such as a foam aid, a foam stabilizer, a catalyst, a hardener, a plasticizer, or a vulcanization accelerator may be added to the above-described material.

In order that the elastic foam layer 100B does not damage the surface of an object (charging member 14) by scratching the surface or in order that the elastic foam layer 100B is prevented from being torn or damaged over time, it is particularly preferable that the elastic foam layer 100B be composed of polyurethane foam, which has a high tensile strength.

Examples of polyurethane include a reactant that reacts with polyol (for example, polyester polyol, polyether polyester, or acryl polyol), and isocyanate (for example, 2,4-toluene diisocyanate, 2,6-toluene diisocyanate, 4,4-diphenylmethane diisocyanate, tolidine diisocyanate, or 1,6-hexamethylene-diisocyanate). The polyurethane may contain a chain extender (1,4-butanediol or trimethylolpropane).

Foaming of polyurethane is typically performed by using a foaming agent such as water or an azo compound (such as azodicarbonamide or azobisisobutyronitrile).

As needed, an agent such as a foam aid, a foam stabilizer, or a catalyst may be added to the polyurethane foam.

Among these types of polyurethane foam, ether-based polyurethane foam is preferable. This is because ester-based polyurethane foam is more likely to deteriorate with heat and humidity. A foam stabilizer containing silicone oil is added to ether-based polyurethane. During storage (particularly, long term storage under high temperature and high humidity), the silicone oil possibly transfers to an object (charging member 14), which causes image defects in some cases. To address this, a foam stabilizer that does not contain silicone oil is used to prevent the elastic foam layer 100B from causing images defects.

Specific examples of a foam stabilizer not containing silicone oil include an organic surfactant not containing Si (for example, an anionic surfactant such as a dodecylbenzenesulfonic acid or a sodium lauryl sulfate).

A method which does not use a silicone-based foam stabilizer may be applied by selecting a polyetherpolyol having a primary hydrogen group as a terminal group thereof and a molecular weight distribution of 1.02 to 1.2 as one of the polyols.

Here, whether ether-based polyurethane foam contains a foam stabilizer not containing silicone oil is determined through a component analysis to determine whether "Si" is contained.

The thickness of the elastic foam layer 100B (thickness at the widthwise middle portion) falls within the range of, for example, 1.0 mm to 3.0 mm, preferably within the range of 1.4 mm to 2.6 mm, or more preferably within the range of 1.6 mm to 2.4 mm.

The thickness of the elastic foam layer 100B is measured by, for example, the following manner.

In the state where a cleaning member is fixed in the circumferential direction, the cleaning member is scanned by a laser measuring device (laser scan micrometer Model No. LSM6200 from Mitutoyo Corporation) in the longitudinal direction (axial direction) of the cleaning member at a traverse speed of 1 mm/s to measure the profile of the thickness of the elastic foam layer (elastic foam layer thickness). Thereafter, the cleaning member is shifted to another position in the circumferential direction and measured similarly (at three positions at 120° intervals in the circumferential direction). On the basis of the obtained profile, the thickness of the elastic foam layer 100B is calculated.

The elastic foam layer 100B is helically disposed. Specifically, for example, it is preferable that a helix angle θ fall within the range of 10° to 65° or more preferably within the range of 20° to 50°, a helix width R1 fall within the range of 3 mm to 25 mm or more preferably within the range of 3 mm to 10 mm, and a helix pitch R2 fall within the range of 3 mm to 25 mm or more preferably within the range of 15 mm to 22 mm (see FIG. 5).

The elastic foam layer 100B preferably has a coverage (helix width R1 of elastic foam layer 100B/[helix width R1 of elastic foam layer 100B+helix pitch R2 of elastic foam layer 100B], that is, R1/(R1+R2)) of 15% to 70%, or more preferably, 25% to 55%.

If the coverage exceeds the above-described range, the time for which the elastic foam layer 100B remains in contact with the object increases, whereby adherents adhering to the surface of the cleaning member are more likely to contaminate the object again. If, on the other hand, the coverage falls below the above-described range, the thickness of the elastic foam layer 100B is less likely to become stable, so that the cleaning performance of the elastic foam layer 100B is more likely to be impaired.

Here, the helix angle θ indicates an angle (acute angle) between the longitudinal direction P (helix direction) of the elastic foam layer 100B and an axial direction Q (core body axial direction) of the core body 100A (see FIG. 5).

The helix width R1 indicates a length of the elastic foam layer 100B in the axial direction Q (core body axial direction) of the cleaning member 100.

The helix pitch R2 indicates a distance between adjacent portions of the elastic foam layer 100B in the axial direction Q (core body axial direction) of the cleaning member 100.

The elastic foam layer 100B indicates a layer composed of a resilient material that returns into the original shape after being deformed by an application of an external force of 100 Pa.

Method for Manufacturing Cleaning Member 100

Subsequently, a method for manufacturing the cleaning member 100 according to this exemplary embodiment is described.

Figure 9:
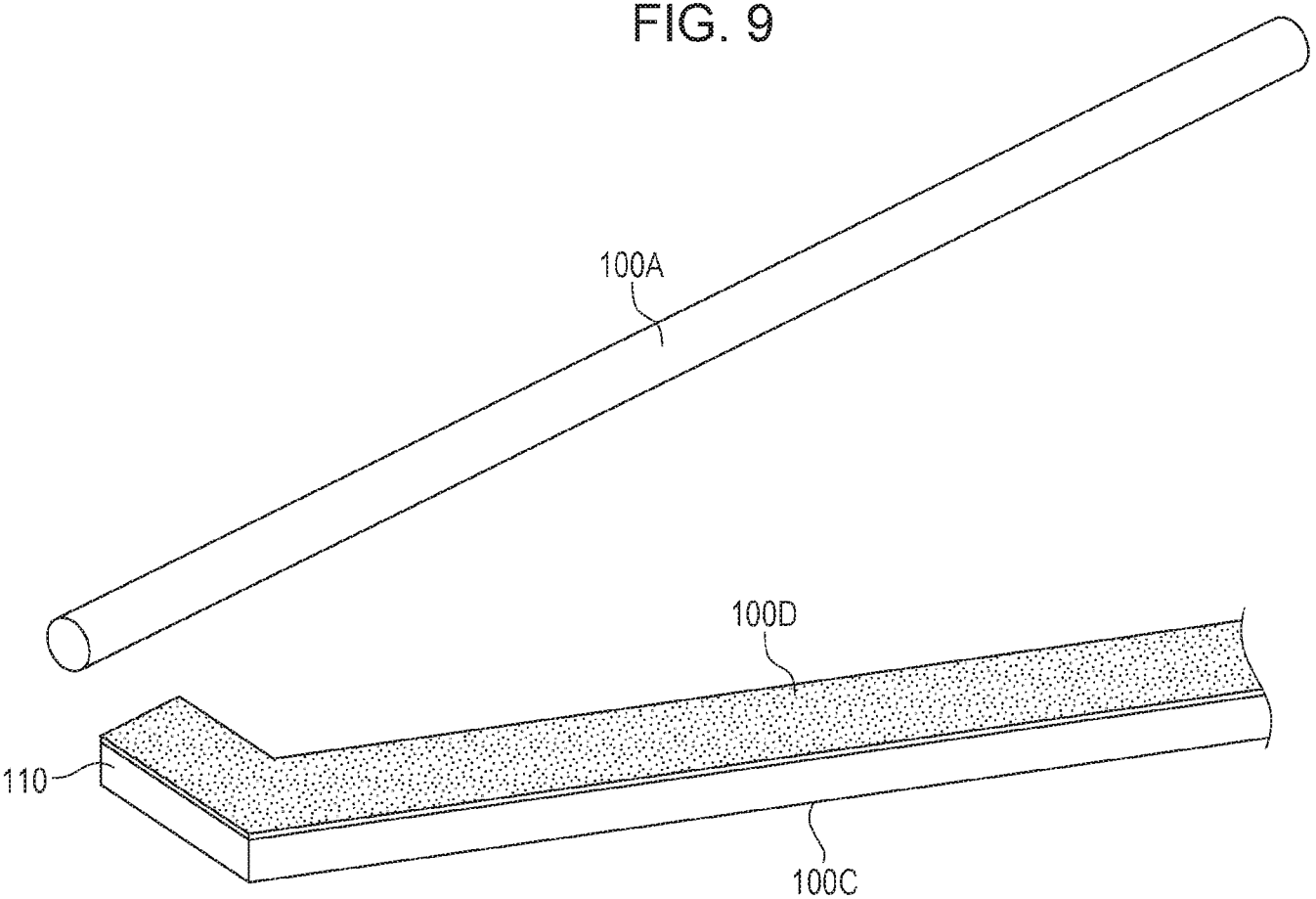
FIG. 9 is a diagram of one process of an example of a method for manufacturing a cleaning member according to an exemplary embodiment.
Figure 10:
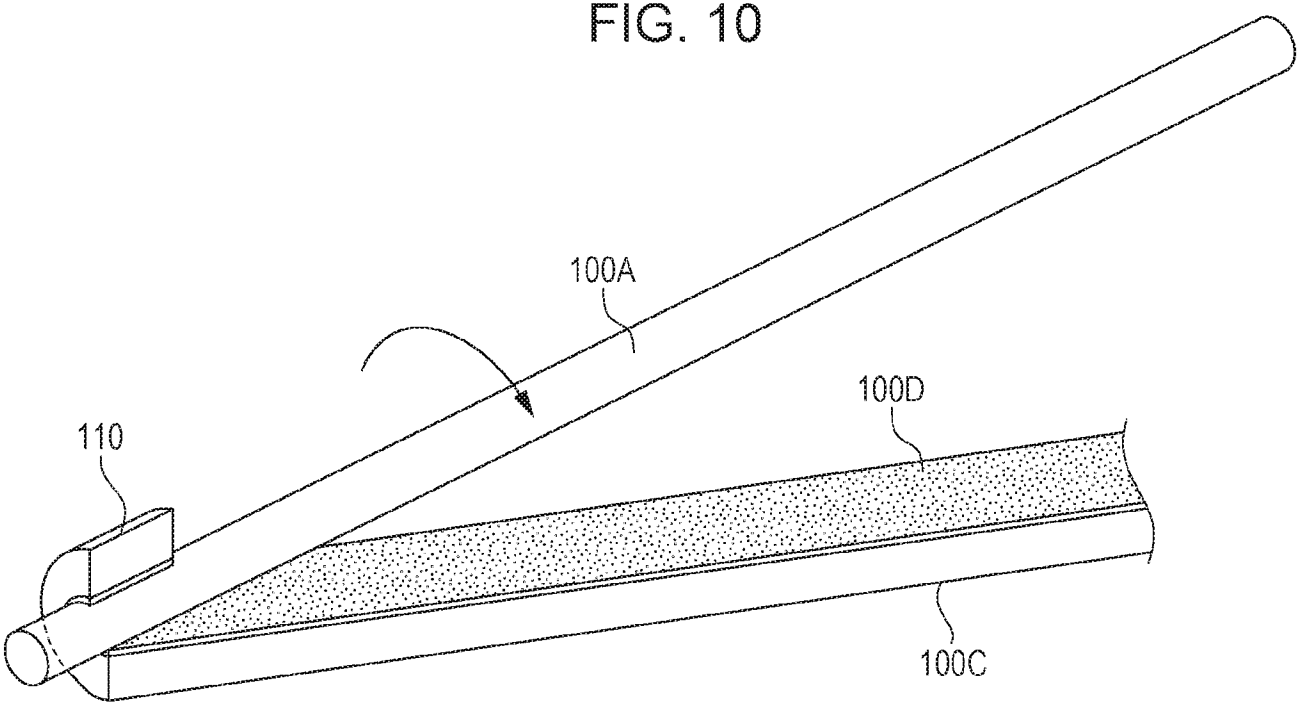
FIG. 10 is a diagram of one process of an example of a method for manufacturing a cleaning member according to an exemplary embodiment.
Figure 11:
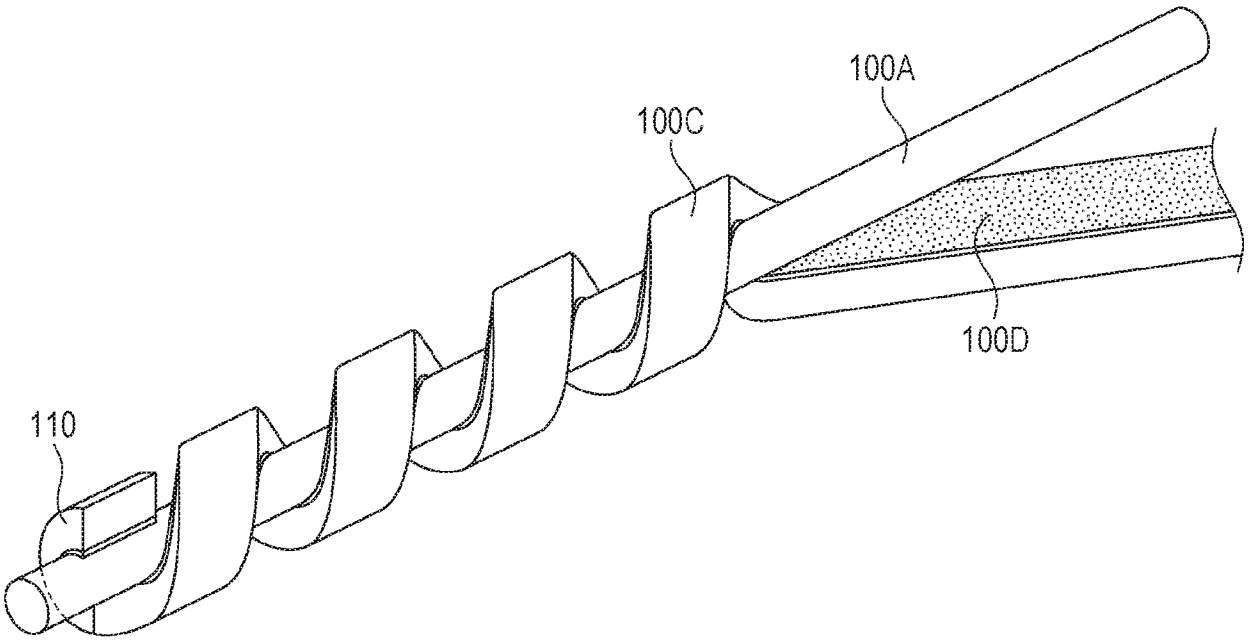
FIG. 11 is a diagram of one process of an example of a method for manufacturing a cleaning member according to an exemplary embodiment.

FIG. 9 to FIG. 11 are diagrams of processes of an example of a method for manufacturing the cleaning member 100 according to this exemplary embodiment.

As illustrated in FIG. 9, first, a sheet-form elastic foam member (polyurethane foam sheet or the like) that has been sliced to have an intended thickness is prepared and the member is punched by a blanking die into a sheet having intended width and length. Here, as described above, the strip 100C includes an overhang 110 and has been subjected to a compression treatment in the thickness direction at an end portion of the overhang 110 in the direction in which it overhangs.

A double-sided tape serving as the bonding layer 100D (hereinafter referred to as the double-sided tape 100D) is bonded to one side of the sheet-form elastic foam member, so that the strip 100C (strip-shaped elastic foam member to which a double-sided tape 100D is attached) having intended width and length is obtained.

As illustrated in FIG. 10, the strip 100C is then placed in the state where its surface to which the double-sided tape 100D is attached faces up. In this state, one end portion of a release paper piece of the double-sided tape 100D is removed and one end portion of the core body 100A is placed on the double-sided tape 100D from which the release paper piece is removed.

As illustrated in FIG. 11, then, the strip 100C is helically wound around the outer circumferential surface of the core body 100A by rotating the core body 100A at an intended speed while the release paper piece of the double-sided tape 100D is being removed. Thus, the cleaning member 100 including the elastic foam layer 100B helically disposed on the outer circumferential surface of the core body 100A is obtained.

When the strip 100C, that is to serve as the elastic foam layer 100B, is wound around the core body 100A, the strip 100C is positioned in such a manner that the longitudinal direction of the strip 100C extends at the intended angle (helix angle) with respect to the axial direction of the core body 100A. The outer diameter of the core body 100A preferably falls within the range of, for example, ϕ3 mm to ϕ6 mm.

Preferably, the strip 100C is wound around the core body 100A under such a tension that a gap is not left between the core body 100A and the double-sided tape 100D on the strip 100C. Applying excessively high tension is not preferable because applying excessively high tension increases the permanent tensile elongation, so that the elastic force of the elastic foam layer 100B, which is required for cleaning, is likely to decrease. Specifically, such a tension is preferable that the strip 100C is elongated by a length within the range greater than 0% and not greater than 5% of the original length of the strip 100C.

On the other hand, winding the strip 100C around the core body 100A is more likely to elongate the strip 100C. This elongation varies in the thickness direction of the strip 100C; an outermost portion is most likely to be elongated, so that the elastic force at that portion may decrease. To address this situation, it is preferable that the strip 100C be wound around the core body 100A in such a manner that the elongation of the outermost portion after the strip 100C is wound around the core body 100A becomes approximately 5% of the elongation of the outermost portion of the original strip 100C.

This elongation depends on the radius of curvature with which the strip 100C is wound around the core body 100A and the thickness of the strip 100C. The radius of curvature with which the strip 100C is wound around the core body 100A depends on the outer diameter of the core body 100A and the angle at which the strip 100C is wound (helix angle θ).

The radius of curvature with which the strip 100C is wound around the core body 100A preferably falls within the range of, for example, ((outer diameter of core body/2)+0.2 mm) to ((outer diameter of core body/2)+8.5 mm), or more preferable, within the range of ((outer diameter of core body/2)+0.5 mm) to ((outer diameter of core body/2)+7.0 mm).

Preferably, the thickness of the strip 100C falls within the range of, for example, 1.5 mm to 4 mm, and more preferably, within the range of 1.5 mm to 3.0 mm. Preferably, the width of the strip 100C is adjusted so that the coverage of the elastic foam layer 100B falls within the above-described range. The length of the strip 100C is determined by, for example, the length of a portion of the strip 100C in the axial direction by which it is wound around the core body 100A, the winding angle (helix angle θ), and the tension under which the strip 100C is wound.

Operation of Exemplary Embodiment

Subsequently, an operation of this exemplary embodiment is described.

In this exemplary embodiment, foreign matter (pollutant) such as a developer remaining on the photoconductor 12 without being transferred to the recording medium 24 is removed by the cleaning blade 80 from the photoconductor 12. Part of foreign matter such as a developer that has slipped through under the cleaning blade 80 without being removed by the cleaning blade 80 adheres to the surface of the charging member 14 (see FIG. 1). In addition, part of foreign matter such as a developer that floats in the air inside the apparatus body 10A of the image forming apparatus 10 adheres to the surface of the charging member 14.

The foreign matter that has adhered to the surface of the charging member 14 is removed as a result of the outer circumferential surface (upper surface in FIG. 6) and the protrusion 122 of the elastic foam layer 100B touching the charging member 14, the outer circumferential surface of the elastic foam layer 100B wiping the outer circumferential surface of the charging member 14, and the protrusion 122 of the elastic foam layer 100B scratching the foreign matter off.

The foreign matter remaining on the outer circumferential surface of the charging member 14 may move from the end portions of the charging member 14 in the axial direction to the end surfaces 14C of the charging member 14 in the axial direction and may adhere to the end surfaces 14C in the axial direction as a result of, for example, the charging member 14 rotating and the cleaning member 100 being driven to rotate. In addition, part of the foreign matter such as a developer that floats in the air inside the apparatus body 10A of the image forming apparatus 10 may adhere to the end surfaces 14C of the charging member 14 in the axial direction.

Here, in this exemplary embodiment, the elastic foam layer 100B is in contact with the end surfaces 14C of the charging member 14 in the axial direction. The relationship between the cross-sectional area Sa of the charging member 14, taken perpendicularly to the axis of the charging member 14, and the cumulative total contact area Sb of a portion of the end surface 14C in the rotation axis direction touched by the elastic foam layer 100B during one rotation of the charging member 14 satisfies approximately $0.11 \leq Sb/Sa <$ approximately 0.30.

Although a clear mechanism has not been proved, when the above-described relationship satisfies approximately $0.11 \leq Sb/Sa <$ approximately 0.30, the charging member 14 is prevented from rotating (being driven to rotate) erroneously with respect to the photoconductor 12, whereby the cleaning performance of the cleaning member 100 of cleaning the outer circumferential surface of the charging member 14 is prevented from deteriorating (see the evaluation results in "Evaluation" described below).

If the relationship $0.11 > Sb/Sa$ holds true (including the case where the elastic foam layer 100B is not in contact with the end surfaces 14C in the axial direction), it is assumed that the elastic foam layer 100B fails to sufficiently touch the end surfaces 14C in the axial direction, so that the elastic foam layer 100B wipes the end surfaces 14C in the axial direction to an insufficient degree. Thus, the foreign matter adhering to the end surfaces 14C in the axial direction accumulates. When the foreign matter accumulates on the end surfaces 14C in the axial direction in the above-described manner, it is assumed that the foreign matter adheres to the core body 14A of the charging member 14 and intrudes into the space between the core body 14A and a bearing (not illustrated) supporting the core body 14A, so that the charging member 14 causes rotation errors (driven to rotate erroneously). When the charging member 14 causes a rotation error, it is assumed that the cleaning member 100 that is driven to rotate by the charging member 14 also causes a rotation error, so that the cleaning performance of the cleaning member 100 of cleaning the outer circumferential surface of the charging member 14 also deteriorates.

When the foreign matter adhering to the end surfaces 14C in the axial direction accumulates, it is assumed that foreign matter on the outer circumferential surface of the charging member 14 is no longer allowed to move to the end surfaces 14C in the axial direction and is thus left at end portions of the outer circumferential surface of the charging member 14 in the axial direction. It is also assumed that the foreign matter accumulated on the end surfaces 14C in the axial direction floats in the air again and then adheres again to the end portions of the outer circumferential surface of the charging member 14 in the axial direction. Thus, it is assumed that the cleaning performance of the cleaning member 100 of cleaning the end portions of the outer circumferential surface of the charging member 14 in the axial direction deteriorates.

If the relationship between the cross-sectional area Sa of the charging member 14 taken perpendicularly to the axis and the cumulative total contact area Sb is $Sb/Sa \geq 0.30$, the strength touched by the elastic foam layer 100B with the end surfaces 14C in the axial direction increases. When the amount by which the elastic foam layer 100B intrudes into the outer circumferential surface of the charging member 14 is increased with an increase of the cumulative total contact area Sb, the strength touched by the elastic foam layer 100B with the outer circumferential surface of the charging member 14 increases. This increase imparts rotational resistance to the charging member 14, so that the charging member 14 assumedly causes a rotation error (driven to rotate erroneously) with respect to the photoconductor 12. When the charging member 14 causes a rotation error, the cleaning member 100, driven to rotate by the charging member 14, also causes a rotation error, so that the cleaning performance of the cleaning member 100 of cleaning the outer circumferential surface of the charging member 14 assumedly deteriorates.

When the relationship between the cross-sectional area Sa of the charging member 14 taken perpendicularly to the axis and the cumulative total contact area Sb satisfies approximately 0.15≤Sb/Sa<approximately 0.25, the charging member 14 with respect to the photoconductor 12 are effectively prevented from rotating erroneously (driven to rotate erroneously), so that the cleaning performance of the cleaning member 100 of cleaning the outer circumferential surface of the charging member 14 is effectively prevented from deteriorating (see the evaluation results in "Evaluation" described below).

When the cleaning performance of the cleaning member 100 of cleaning the outer circumferential surface of the charging member 14 is prevented from deteriorating in this manner, foreign matter on the outer circumferential surface of the charging member 14 is preferably removed, so that charging errors of the charging member 14 are reduced. When rotation errors (errors caused when driven to rotate) of the charging member 14 with respect to the photoconductor 12 are reduced, the charging member 14 is prevented from being worn by being rubbed against the photoconductor 12, so that charging errors of the charging member 14 are reduced. Thus, according to this exemplary embodiment, charging errors of the charging member 14 attributable to rotation errors (errors caused when driven to rotate) of the charging member 14 with respect to the photoconductor 12 are reduced. Image defects attributable to charging errors of the charging member 14 are thus reduced.

Modified Example of Cleaning Member 100

In the cleaning member 100, a circumferential coverage width of the elastic foam layer 100B by which the elastic foam layer 100B covers each end portion of the core body 100A in the axial direction may be greater than a circumferential coverage width of the elastic foam layer 100B by which the elastic foam layer 100B covers a middle portion of the core body 100A in the axial direction. Here, the "circumferential coverage width" indicates a width of the elastic foam layer 100B by which the elastic foam layer 100B covers the outer circumferential surface of the core body 100A in the circumferential direction of the core body 100A.

As illustrated in FIGS. 12A to 12D, the strip 100C according to this modified example is formed in such a manner that both end portions (only one of the end portions is illustrated in FIGS. 12A to 12D) of the strip 100C in the longitudinal direction (A direction) have a greater width, extending in the widthwise direction (B direction) perpendicular to the longitudinal direction, than a middle portion in the longitudinal direction.

Figure 12A:
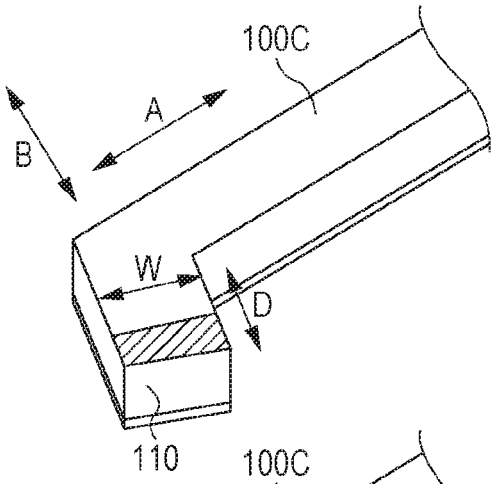
FIGS. 12A to 12D are cross-sectional views of elastic foam layers of a cleaning member according to another exemplary embodiment, viewed in an enlarged manner.

Specifically, the strip 100C illustrated in FIG. 12A has an overhang 110 (protrusion) that protrudes toward one side in the cross direction at an end portion of the strip 100C in the longitudinal direction. Here, the width W of the overhang 110 (dimension in a direction perpendicular to the extension direction D) is uniform in the extension direction D.

Figure 12B:
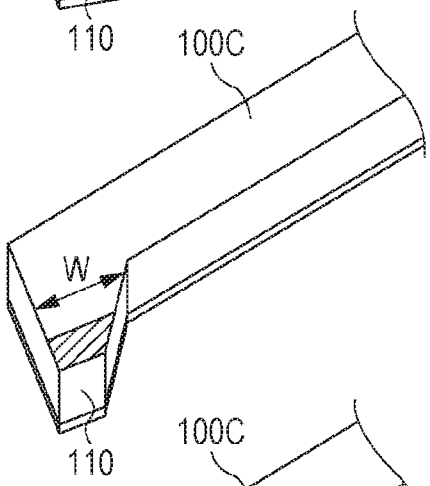
Figure 12C:
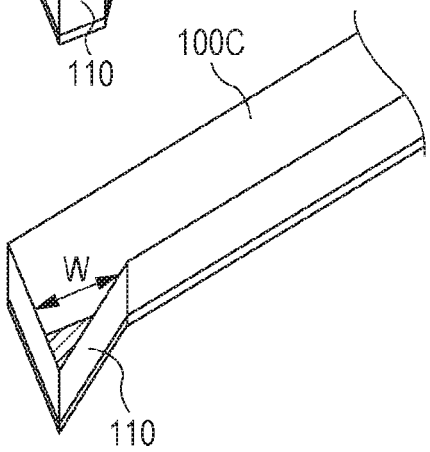
Figure 12D:
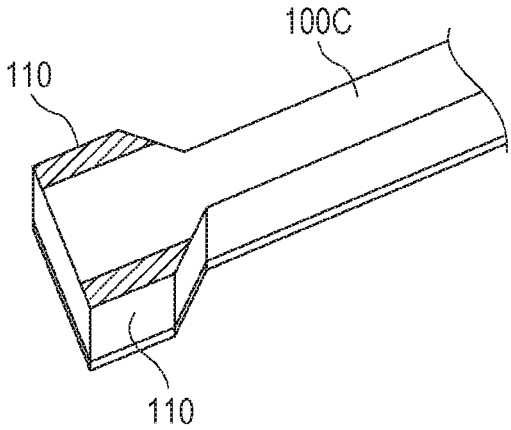

The strip 100C may be in other forms, such as strips 100C illustrated in FIGS. 12B, 12C, and 12D. Each of the strips 100C illustrated in FIGS. 12B and 12C has an overhang 110 (protrusion) that protrudes toward one side in the cross direction at an end portion of the strip 100C in the longitudinal direction. In the strip 100C illustrated in FIG. 12B, the width W of the overhang 110 gradually decreases toward the end in the extension direction. In the strip 100C illustrated in FIG. 12C, the width W of the overhang 110 gradually decreases toward the end in the extension direction so that the end of the overhang 110 in the extension direction has an acute angle. The strip 100C illustrated in FIG. 12D has overhangs 110 (protrusions) that protrude toward both sides in the cross direction at an end portion of the strip 100C in the longitudinal direction.

Preferably, the ratio of the circumferential coverage width at an end portion (overhang 110) in the axial direction to the circumferential coverage width at the middle portion of the core body 100A in the axial direction is greater than or equal to 1.1, more preferably, greater than or equal to 1.6.

In each of the strips 100C illustrated in FIGS. 12A to 12D, the overhangs 110 may be subjected to a compression treatment in the thickness direction, as described above, at an end portion in the extension direction. For example, the portion of each strip 100C that has been subjected to the compression treatment is hatched in FIGS. 12A to 12D.

In each of the modified examples described above, the circumferential coverage width of the elastic foam layer 100B by which the elastic foam layer 100B covers both end portions of the core body 100A in the axial direction is greater than the circumferential coverage width of the elastic foam layer 100B by which the elastic foam layer 100B covers the middle portion of the core body 100A in the axial direction. Thus, the contact area of the charging member 14 touched by the end portions of the elastic foam layer 100B in the axial direction per rotation is greater than the contact area of the charging member 14 touched by the middle portion of the core body 100A in the axial direction per rotation. Thus, the cleaning performance of the cleaning member 100 of cleaning the end portions of the outer circumferential surface of the charging member 14 in the axial direction is prevented from deteriorating.

In this exemplary embodiment, the cleaning member 100 is pressed against the charging member 14 by the load F' at both end portions of the core body 100A in the axial direction. Thus, the frictional force between the elastic foam layer 100B and the charging member 14 at both end portions of the core body 100A in the axial direction is ensured.

Thus, the cleaning member 100 that is driven to rotate by rotation of the charging member 14 becomes more smoothly rotated than in the case where the circumferential coverage width of the elastic foam layer 100B by which the elastic foam layer 100B covers both end portions of the core body 100A in the axial direction is equivalent to the circumferential coverage width of the elastic foam layer 100B by which the elastic foam layer 100B covers the middle portion of the core body 100A in the axial direction. Thus, the cleaning performance of the cleaning member 100 of cleaning the charging member 14 is enhanced.

Particularly, when the ratio of the circumferential coverage width of the elastic foam layer 100B by which the elastic foam layer 100B covers the end portions in the axial direction to the circumferential coverage width of the elastic foam layer 100B by which the elastic foam layer 100B covers the middle portion of the core body 100A in the axial direction is greater than or equal to 1.1, the cleaning member 100 is driven to rotate more smoothly than in the case where the above-described ratio is 1.0. The cleaning member 100 is driven to rotate further more smoothly when the above-described ratio is greater than or equal to 1.6.

The above-described cumulative total contact area Sb increases with an increase of the circumferential coverage width of the elastic foam layer 100B by which the elastic foam layer 100B covers the end portions of the core body 100A in the axial direction and with an increase of the amount by which the elastic foam layer 100B intrudes into the elastic layer 14B (the amount by which the elastic foam layer 100B protrudes toward the core body 14A at the end surfaces 14C in the axial direction).

On the other hand, if the amount by which the elastic foam layer 100B intrudes into the outer circumferential surface of the charging member 14 is too large, the strength touched by the elastic foam layer 100B with the outer circumferential surface of the charging member 14 becomes excessively large, so that rotation errors (errors caused when driven to rotate) of the charging member 14 with respect to the photoconductor 12 are more likely to occur. Moreover, if the entire area of the outer circumferential surface of the charging member 14 touched by the elastic foam layer 100B is excessively large, rotation errors (errors caused when driven to rotate) of the charging member 14 with respect to the photoconductor 12 are more likely to occur similarly.

In the above-described modified example, the above-described cumulative total contact area Sb is ensured without increasing the above-described amount by which the elastic foam layer 100B intrudes and the contact area of the entirety of the elastic foam layer 100B since the circumferential coverage width of the elastic foam layer 100B by which the elastic foam layer 100B covers both end portions of the core body 100A in the axial direction is larger than the circumferential coverage width of the elastic foam layer 100B by which the elastic foam layer 100B covers the middle portion of the core body 100A in the axial direction. In other words, in the modified example, the above-described cumulative total contact area Sb is ensured while rotation errors of the charging member 14 with respect to the photoconductor 12 are kept low.

Another Modified Example of Cleaning Member 100

In this exemplary embodiment, the elastic foam layer 100B is in contact with both end surfaces 14C of the charging member 14 in the axial direction. However, the elastic foam layer 100B suffices if it touches at least one of the end surfaces 14C of the charging member 14 in the axial direction.

Figure 13:
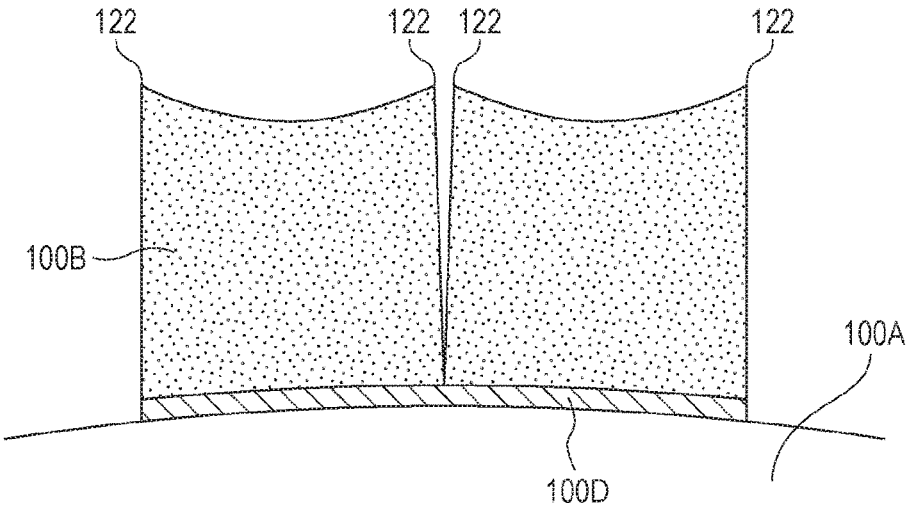
FIG. 13 is a cross-sectional view of an elastic foam layer of a cleaning member according to another exemplary embodiment, viewed in an enlarged manner.

The elastic foam layer 100B is not limited to the form composed of a single strip 100C. For example, as illustrated in FIG. 13 and FIG. 14, the elastic foam layer 100B may be composed of at least two strips 100C (strip-shaped elastic foam members) and the at least two strips 100C may be helically wound around the core body 100A.

Figure 14:
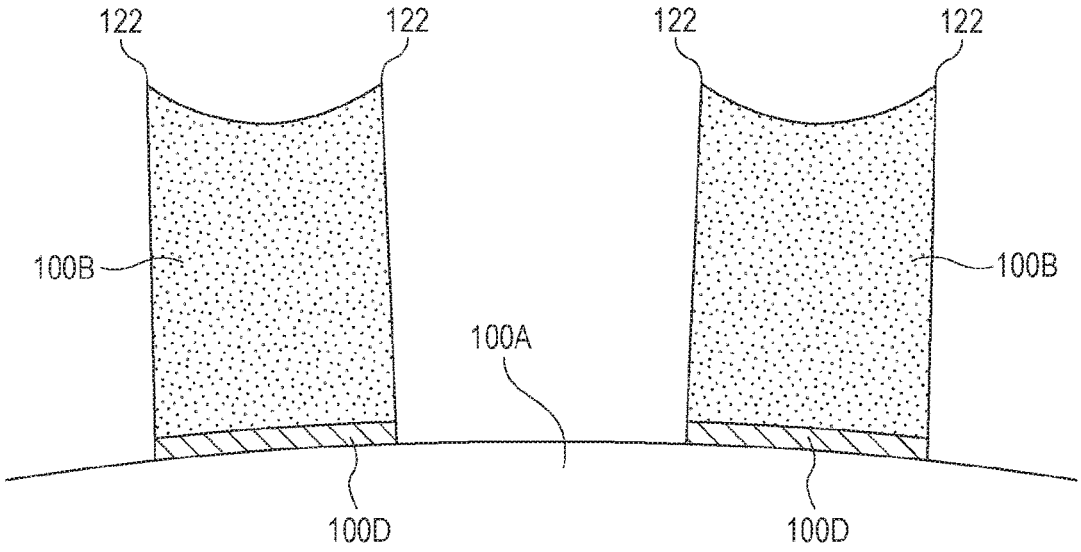
FIG. 14 is a schematic perspective view of an end portion, in a longitudinal direction, of a strip of a cleaning member according to another exemplary embodiment.

In addition, the elastic foam layer 100B composed of at least two strips 100C (strip-shaped elastic foam member) helically wound around the core body 100A may be helically wound around the core body 100A in the state where the longitudinal sides of the adherent surfaces of the strips 100C (surfaces of the strips 100C facing the outer circumferential surface of the core body 100A) are in contact with each other (see FIG. 13) or not in contact with each other (see FIG. 14).

In this exemplary embodiment, the charging member 14 is driven to rotate by rotation of the photoconductor 12. However, this is not the only possible configuration. For example, the charging member 14 may rotate without being driven to rotate.

In this exemplary embodiment, the end portions of the elastic foam layer 100B in the axial direction extend outward beyond the respective end portions of the elastic layer 14B in the axial direction and, at the end portions of the elastic foam layer 100B in the axial direction, the relationship between the cross-sectional area Sa of the charging member 14 taken perpendicularly to the axis and the cumulative total contact area Sb satisfies the above-described conditions. However, this is not the only possible configuration. Only one of the end portions of the elastic foam layer 100B in the axial direction may extend outward beyond the corresponding end portion of the elastic layer 14B in the axial direction and, at the one end portion of the elastic foam layer 100B in the axial direction, the relationship between the cross-sectional area Sa of the charging member 14 taken perpendicularly to the axis and the cumulative total contact area Sb may satisfy the above-described conditions.

In the image forming apparatus 10 according to this exemplary embodiment, the charging device 11 is described as having a unit including the charging member 14 and the cleaning member 100, that is, the charging member 14 is used as an object that is to be cleaned. However, this is not the only possible configuration. For example, examples of the object that is to be cleaned include a photoconductor (image carrier), a transfer device (transfer member or transfer roller), and an intermediate transfer body (intermediate transfer belt). A unit including such an object and a cleaning member disposed so as to be in contact with the object may be directly disposed on the image forming apparatus or may be disposed on the image forming apparatus in the form of a cartridge as in the case of the above-described process cartridge.

The present invention is not limited to the above-described exemplary embodiments and may be modified, changed, or improved within the range not departing from the gist of the invention. For example, the above-described modified examples may be appropriately combined.

EXAMPLE

The present invention is specifically described using some examples below. However, the present invention is not limited to these examples.

Example 1

Production of Cleaning Roller 1

A polyurethane foam (EP-70 from Inoac Corporation) sheet having a thickness of 2.3 mm was cut into a strip having a width of 3 mm and a length of 230 mm. A piece of double-sided tape (No 5605 from Nitto Denko Corporation) having a thickness of 0.05 mm was bonded to the entire surface of the cut strip to obtain a strip to which a double-sided tape is attached.

The strip thus obtained was placed on a flat table in such a manner that a release paper piece attached to the double-sided tape faces down. Then, the strip was compressed from above using heated stainless steel so as to reduce the thickness of an end area of the strip having a circumferential width of 1 mm to 15%.

The obtained strip to which the double-sided tape is attached was placed on a flat table in such a manner that a release paper piece attached to the double-sided tape faces up. Then, the strip was wound around a metal core body (material of SUM24EZ, outer diameter of $\phi$4.0 mm, and full length of 236 mm) at a helix angle $\theta$ of 15° while receiving such tension that the full length of the strip is extended by approximately greater than 0% and not greater than 5%. Thus, a helically disposed elastic foam layer was formed, so that the cleaning roller 1 (an example of the cleaning member 100) was obtained.

Here, the distance (full length) from one end portion to the other end portion of the elastic foam layer of the obtained cleaning roller 1 in the axial direction was 226 mm.

Production of Charging Roller

Forming of Elastic Layer

The following materials were kneaded by open rollers, the mixture was applied to the surface of an electric conductive supporter composed of SUS416 and having a diameter of 6 mm so as to cover the surface in a cylinder form having a thickness of 1.5 mm. What was obtained was placed in a cylindrical die having an inner diameter of 9.0 mm and subjected to vulcanization for 30 minutes at 170° C. After removed from the die, what was obtained was polished, so that a cylindrical electric conductive elastic layer A was obtained.

- rubber material in the amount of 100 parts by weight (epichlorohydrin-ethylene oxide-allyl glycidyl ether copolymer rubber Gechron3106 from Zeon Corporation);
- electric conductive agent (carbon black Asahi Thermal from Asahi Carbon Co., Ltd.) in the amount of 25 parts by weight;
- electric conductive agent (Ketjenblack EC from Lion Corporation) in the amount of 8 parts by weight;
- ionic conductive agent (lithium perchlorate) in the amount of 1 part by weight;
- curing agent (sulfur 200 mesh from Tsurumi Chemical) in the amount of 1 part by weight;
- vulcanization accelerator (NOCCELER DM from Ouchi Shinko Chemical Industrial Co., Ltd) in the amount of 2.0 parts by weight; and
- vulcanization accelerator (NOCCELER TT from Ouchi Shinko Chemical Industrial Co., Ltd) in the amount of 0.5 parts by weight.

Forming of Surface Layer

A dispersed solvent A obtained by dispersing the following materials with a bead mill was diluted with methanol and the surface of the electric conductive elastic layer A was immersed in the solvent A. Then, the electric conductive elastic layer A was heated and dried for 15 minutes at 140° C. to form a surface layer having a thickness of 4 μm, so that an electric conductive roller was obtained. This roller was used as a charging roller (example of the charging member 14). Here, the full length of a rubber portion (an example of the elastic layer 14B) of the charging roller in the axial direction was 224 mm.

- polymeric material in the amount of 100 parts by weight (copolymer nylon AMILAN CM8000 from Toray Industries, Inc.);
- electric conductive agent in the amount of 30 parts by weight (antimony-doped tin oxide SN-100P from Ishihara Sangyo Kaisha, Ltd.);
- solvent (methanol) in the amount of 500 parts by weight; and
- solvent (butanol) in the amount of 240 parts by weight.

Example 2

Production of Cleaning Roller 2

A cleaning roller 2 was produced in the same manner as in the case of the cleaning roller 1 except that the thickness of the polyurethane foam sheet was changed to 2.6 mm.

Example 3

Production of Cleaning Roller 3

A cleaning roller 3 was produced in the same manner as in the case of the cleaning roller 1 except that the thickness of the polyurethane foam sheet was changed to 3.2 mm.

Example 4

Production of Cleaning Roller 4

A cleaning roller 4 was produced in the same manner as in the case of the cleaning roller 1 except that the width of the polyurethane foam sheet was changed to 4 mm.

Example 5

Production of Cleaning Roller 5

A cleaning roller 5 was produced in the same manner as in the case of the cleaning roller 1 except that the width of the polyurethane foam sheet was changed to 5 mm.

Example 6

Production of Cleaning Roller 6

A cleaning roller 6 was produced in the same manner as in the case of the cleaning roller 1 except that the width of the polyurethane foam sheet was changed to 5 mm and the thickness of the polyurethane foam sheet was changed to 2.6 mm.

Example 7

Production of Cleaning Roller 7

A cleaning roller 7 was produced in the same manner as in the case of the cleaning roller 1 except that the width of the polyurethane foam sheet was changed to 6 mm.

Example 8

Production of Cleaning Roller 8

A cleaning roller 8 was produced in the same manner as in the case of the cleaning roller 1 except that the width of the polyurethane foam sheet was changed to 3 mm and the polyurethane foam sheet had rectangular overhangs 110 as illustrated in FIG. 12A at both end portions, each overhang having a width W (width extending in the axial direction of the core body 100A) of 2.2 mm at the proximal end, a width W of 2.2 mm at the distal end, and the full circumferential width of 5.2 mm.

Example 9

Production of Cleaning Roller 9

A cleaning roller 9 was produced in the same manner as in the case of the cleaning roller 1 except that the width of the polyurethane foam sheet was changed to 3 mm, the thickness of the polyurethane foam sheet was changed to 2.6 mm, and the polyurethane foam sheet had rectangular overhangs 110 as illustrated in FIG. 12A at both end portions, each overhang having a width W (width extending in the axial direction of the core body 100A) of 2.2 mm at the proximal end, a width W of 2.2 mm at the distal end, and the full circumferential width of 5.2 mm.

Comparative Example 1

Production of Comparative Cleaning Roller 1

A comparative cleaning roller 1 was produced in the same manner as in the case of the cleaning roller 1 except that the thickness of the polyurethane foam sheet was changed to 1.7 mm.

Comparative Example 2

Production of Comparative Cleaning Roller 2

A comparative cleaning roller 2 was produced in the same manner as in the case of the cleaning roller 1 except that the thickness of the polyurethane foam sheet was changed to 3.3 mm.

Comparative Example 3

Production of Comparative Cleaning Roller 3

A comparative cleaning roller 3 was produced in the same manner as in the case of the cleaning roller 1 except that the width of the polyurethane foam sheet was changed to 5 mm and the thickness of the polyurethane foam sheet was changed to 1.7 mm.

Comparative Example 4

Production of Comparative Cleaning Roller 4

A comparative cleaning roller 4 was produced in the same manner as in the case of the cleaning roller 1 except that the distance (full length) from one end portion to the other end portion of a helically disposed elastic foam layer in the axial direction was adjusted to 224 mm.

Comparative Example 5

Production of Comparative Cleaning Roller 5

A comparative cleaning roller 5 was produced in the same manner as in the case of the cleaning roller 1 except that the thickness of the polyurethane foam sheet was changed to 2.6 mm and the distance (full length) from one end portion to the other end portion of a helically disposed elastic foam layer in the axial direction was adjusted to 224 mm.

Evaluation

Examples 1 to 9 and Comparative Examples 1 to 5 were evaluated in terms of how smoothly the charging member is driven to rotate and the cleaning performance by using the cleaning rollers and the charging rollers produced according to the examples while the amount by which each cleaning roller intrudes was adjusted.

Evaluation of how Smoothly Charging Member is Driven to Rotate

Together with the cleaning roller of each example, the charging roller was mounted on a drum cartridge of a monochrome laser printer DocuPrint P355d from Fuji Xerox Co., Ltd. and tests for evaluation of how smoothly the charging member is driven to rotate were conducted.

The evaluation tests were conducted under the conditions of 10° C. and 15 RH % after an image quality pattern having an average image density of 5% was printed on 50,000 A4 sheets and the drum cartridge was then removed. A rotary motor was attached to the photoconductor drum to drive the photoconductor drum at a rotational speed of 1300 rpm. The rotation period of the charging roller that had been driven to rotate was measured by a laser displacement meter (FS-31V from Keyence Corporation). Then, how smoothly the charging roller is driven to rotate, which is subject to pollution, was evaluated on the basis of the following criteria. Evaluation of How Smoothly Charging Member is Driven to Rotate: Evaluation Criteria G0: the ratio of the rotation period of the charging roller to the rotation period of the photoconductor drum is greater than 95% and smaller than or equal to 100%;

G0.5: the ratio of the rotation period of the charging roller to the rotation period of the photoconductor drum is greater than 90% and smaller than or equal to 95%;

G1: the ratio of the rotation period of the charging roller to the rotation period of the photoconductor drum is greater than 80% and smaller than or equal to 90%; and G2: the ratio of the rotation period of the charging roller to the rotation period of the photoconductor drum is smaller than or equal to 80%.

Cleaning Performance of End Portions of Charging Roller in Axial Direction (Cleaning Performance Evaluation)

Together with the cleaning roller of each example, the charging roller was mounted on a drum cartridge of the monochrome laser printer DocuPrint P355d from Fuji Xerox Co., Ltd. and tests for cleaning performance evaluation were conducted.

The evaluation tests were conducted under the conditions of 10° C. and 15 RH % after an image quality pattern having an average image density of 5% was printed on 50,000 A4 sheets. Then, a half tone image having a concentration of 50% was output and the concentration unevenness of the charging roller due to the cleaning roller (cleaning performance of the cleaning roller) was evaluated. Specifically, the image concentration was randomly measured using X-rite 404 at ten points within the range of 5 mm from both edges in the image printable area. From the difference between the maximum concentration and the minimum concentration, the cleaning performance was evaluated on the basis of the following criteria.

Cleaning Performance Evaluation: Evaluation Criteria

G0: the difference between the maximum concentration and the minimum concentration is smaller than or equal to 0.05;

G0.5: the difference between the maximum concentration and the minimum concentration is larger than 0.05 and smaller than or equal to 0.10;

G1: the difference between the maximum concentration and the minimum concentration is larger than 0.10 and smaller than or equal to 0.15; and G2: the difference between the maximum concentration and the minimum concentration is larger than 0.15.

The evaluation results illustrated in FIG. 15 reveal that the examples have better evaluation results in how smoothly the charging member is driven to rotate and in cleaning performance than in the case of the comparative examples. Here, foreign matter is more likely to adhere to end portions of the charging roller in the axial direction. Assumedly, the charging roller has preferable cleaning performance in a middle portion in the axial direction if it has preferable cleaning performance in the end portions in the axial direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a cleaning member that includes a shaft portion disposed so as to extend in a rotation axis direction of a rotating object that is to be cleaned, and an elastic layer helically disposed on an outer circumferential surface of the shaft portion from one end portion to the other end portion in an axial direction, the elastic layer touching an outer circumferential surface of the object and at least one end surface of the object in the rotation axis direction, wherein a relationship between a cross-sectional area Sa of the object taken perpendicular to an axis of the object and a cumulative total contact area Sb of a portion of the at least one end surface of the object in the rotation axis direction touched by the elastic layer during one rotation of the object satisfies approximately $0.11 \leq Sb/Sa <$ approximately 0.30.

2. The cleaning device according to claim 1, wherein the relationship between the cross-sectional area Sa of the object taken perpendicular to the axis of the object and the cumulative total contact area Sb of a portion of the at least one end surface of the object in the rotation axis direction touched by the elastic layer during one rotation of the object satisfies approximately $0.15 \leq Sb/Sa <$ approximately 0.25.

3. The cleaning device according to claim 1, wherein the elastic layer has a wider width in a circumferential direction over an end portion of the shaft portion in the axial direction than a width in the circumferential direction over a middle portion of the shaft portion in the axial direction.

4. The cleaning device according to claim 1, wherein a ratio of a width of the elastic layer in a circumferential direction over an end portion of the shaft portion in the axial direction to a width of the elastic layer in the circumferential direction over a middle portion of the shaft portion in the axial direction (circumferential coverage width over an end portion in the axial direction/circumferential coverage width over a middle portion in the axial direction) is higher than or equal to approximately 1.1.

5. The cleaning device according to claim 1, wherein a ratio of a width of the elastic layer in a circumferential direction over an end portion of the shaft portion in the axial direction to a width of the elastic layer in the circumferential direction over a middle portion of the shaft portion in the axial direction (circumferential coverage width over an end portion in the axial direction/circumferential coverage width over a middle portion in the axial direction) is higher than or equal to approximately 1.6.

6. An assembly attachable to and detachable from an apparatus body as an integral unit, the assembly comprising:

an image carrier capable of holding images and serving as an object that is to be charged; and the cleaning device according to claim 1 including a charger, which charges the image carrier with electricity and serves as the object that is to be cleaned, and the cleaning member, which touches a surface of the charger to clean the surface of the charger.

7. An image forming apparatus comprising:

an image carrier capable of holding images and serving as an object that is to be charged; and the cleaning device according to claim 1 including a charger, which charges the image carrier with electricity and serves as the object that is to be cleaned, and the cleaning member, which touches a surface of the charger to clean the surface of the charger.

* * * * *